United States Patent [19]

Hedelin

[11] Patent Number: 4,490,971

[45] Date of Patent: Jan. 1, 1985

[54] METHOD FOR REGULATING THE OPERATING CYCLE IN AN EXTERNAL COMBUSTION ENGINE

[76] Inventor: Lars G. B. Hedelin, Skärsnäsvägen 5, S-182 63 Djursholm, Sweden

[21] Appl. No.: 355,590

[22] PCT Filed: Jul. 1, 1981

[86] PCT No.: PCT/SE81/00201

§ 371 Date: Feb. 22, 1982

§ 102(e) Date: Feb. 22, 1982

[87] PCT Pub. No.: WO82/00178

PCT Pub. Date: Jan. 21, 1982

[30] Foreign Application Priority Data

Jul. 2, 1980 [SE] Sweden ..... 8004909

[51] Int. Cl.[3] ..... F02G 3/02

[52] U.S. Cl. ..... 60/39.63; 123/316; 417/298

[58] Field of Search ..... 60/39.6, 39.63; 123/316; 417/298

[56] References Cited

U.S. PATENT DOCUMENTS

| | | | |
|---|---|---|---|
| 980,801 | 1/1911 | Kraus | 60/39.63 X |
| 2,140,085 | 12/1938 | Maina | 60/39.63 X |
| 3,034,441 | 5/1962 | Wachsmuth | 417/298 X |
| 3,893,295 | 7/1975 | Airas . | |
| 3,919,986 | 11/1975 | Goto | 123/316 |
| 3,939,652 | 2/1976 | Hubers . | |
| 3,986,351 | 10/1976 | Woods et al. | 123/316 X |

FOREIGN PATENT DOCUMENTS

| | | | |
|---|---|---|---|
| 2730608 | 1/1979 | Fed. Rep. of Germany | 123/316 |
| 2901186 | 7/1980 | Fed. Rep. of Germany | 123/316 |
| 1415463 | 11/1975 | United Kingdom . | |

*Primary Examiner*—Michael Koczo

*Attorney, Agent, or Firm*—Ostrolenk, Faber, Gerb & Soffen

[57] ABSTRACT

An engine having a working chamber and a combustion chamber and a method for operating it are disclosed. The amount and compression ratio of air entering the combustion chamber are controlled by valves at the working chamber. The maximum possible amount of air is inducted into the working chamber, and then air is discharged until an amount necessary for the existing load on the engine remains. This remaining air is then compressed to a predetermined constant compression ratio at which it enters the combustion chamber. A proportional amount of fuel is supplied, and the resulting combustion gas is then transferred to do work in the working chamber. The amount of combustion gas transferred is sufficient to maintain a substantially constant pressure in the combustion chamber.

19 Claims, 10 Drawing Figures

METHOD FOR REGULATING THE OPERATING CYCLE IN AN EXTERNAL COMBUSTION ENGINE

Figure 1:
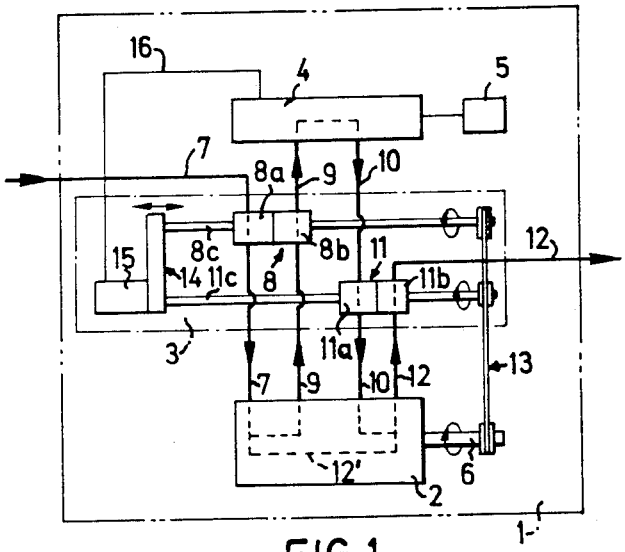

The invention relates to a method for regulating the operating cycle in a combustion engine, where after induction, an operating medium which is preferably air, is compressed, supplied with fuel, combusted, performs work and flows out. The invention also relates to a combustion engine having a variable working volume.

In a conventional combustion engine, e.g. of the Otto type and intended for use in a vehicle, the amount of air required is regulated by means of a throttle in response to the actual engine load. The volume of inducted air will not change in response to the engine load, but the pressure of the inducted air will, and will thus vary in response to the throttle setting. This means that compression of all inducted air will yield a compression pressure in response to the throttle setting. In order to obtain good combustion, a richer fuel-air mixture is required at low engine load than at high engine load. Also, the temperature ratio between the combustion gases and the exhaust gases becomes lower at low engine load than at high engine load. This results in poor efficiency at low engine load.

In addition, at a certain throttle setting the pressure of the inducted air will decrease as the engine speed increases. This is due to the fact that the inlet valves "close too early" at increasing engine speeds. The result is that the engine torque curve descends at high engine speeds because the valve timing is not quite adequate for the full engine operating range.

The object of the invention is to eliminate the drawbacks mentioned and to provide a combustion engine with improved efficiency.

This is achieved in accordance with the invention in that the quantity of operating medium is regulated by allowing the engine to suck in a maximum amount thereof, subsequent to which a regulatably great amount is allowed to flow out again without being compressed, and in that the remaining quantity of sucked-in operating medium is compressed and supplied with fuel.

Preferably a predetermined pressure level is obtained by compression, and fuel is supplied in proportion to the quantity of operating medium being compressed. By regulating the quantity of operating medium being compressed in response to the actual engine load, with a greater quantity for a greater load and a smaller quantity for a smaller load, very efficient engine operation is obtained.

A combustion engine that is provided with a work unit having work chambers in which operating medium, preferably air, is sucked in and compressed by means of operating means and performs work via said operating means after the supply of fuel and combustion, as well as a valve unit for regulating the flow to and from the work chambers is, according to the invention, characterized in that for each work chamber there is included in the valve unit an exhaust valve which, for regulating the utilized compression volume in the work chamber, is adapted to be open during a regulatably great portion of the initial phase of the compression movement of the operating means, whereby a regulatably great portion of the maximum quantity of operating medium sucked into the work chamber can be allowed to flow out again from the work chamber without being compressed.

Thus, according to the invention, no conventional throttle is used to control the amount of air used in the engine. Rather, the engine is allowed to induct all the time, without the presence of constrictions, the maximum amount of air possible, and then a controllable portion of said amount is allowed to leave the engine again without being compressed. The remaining amount of air is then compressed, and fuel is added for combustion. In this way it becomes possible to always compress the actually required amount of air to a predetermined pressure level, and it also becomes possible to always supply fuel in direct proportion to the amount of air compressed; a procedure that has hitherto not been possible. As a result, the engine will always, even at low load, operate at maximum efficiency, i.e. at conditions normally at hand in full throttle operation with a conventional engine. The engine power is regulated only by regulating the actual work volume, i.e. by varying the amount of air to be retained for compression. There is no use of a constriction in the inlet, and neither is there any variation in the air-fuel ratio.

Further distinguishing features and advantages of the invention are apparent from the continued description and the patent claims.

Figure 2:
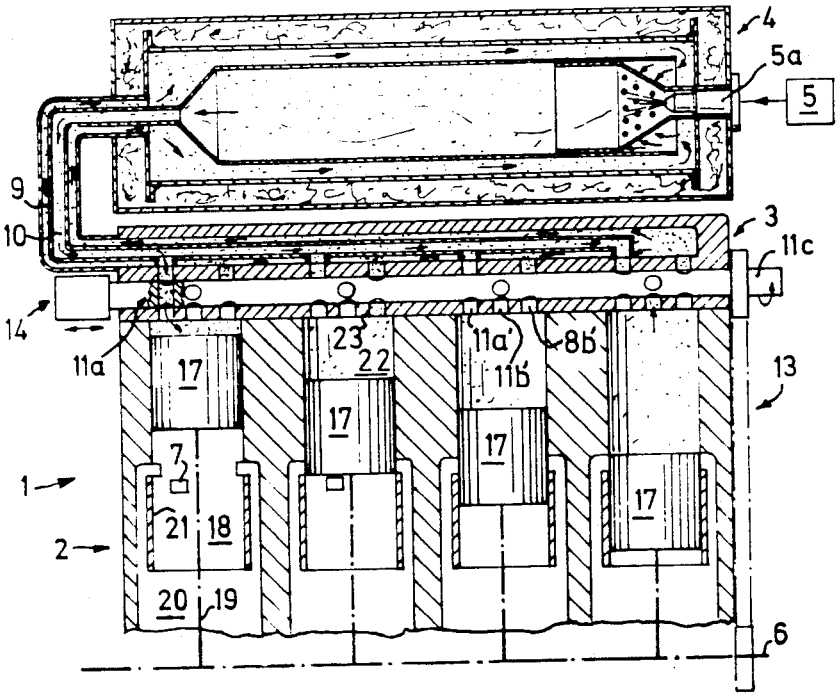
Figure 3:
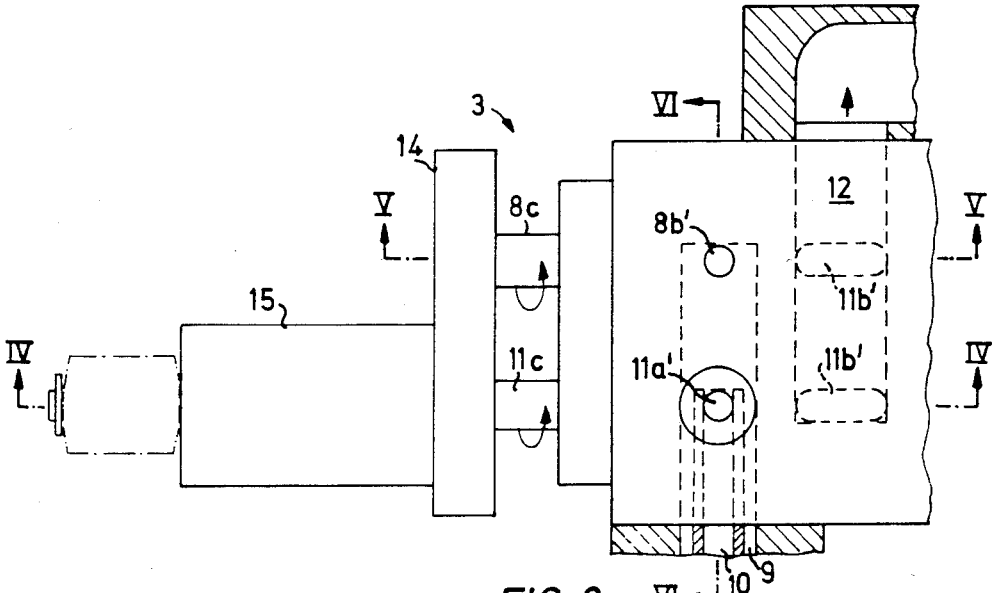
Figure 4:
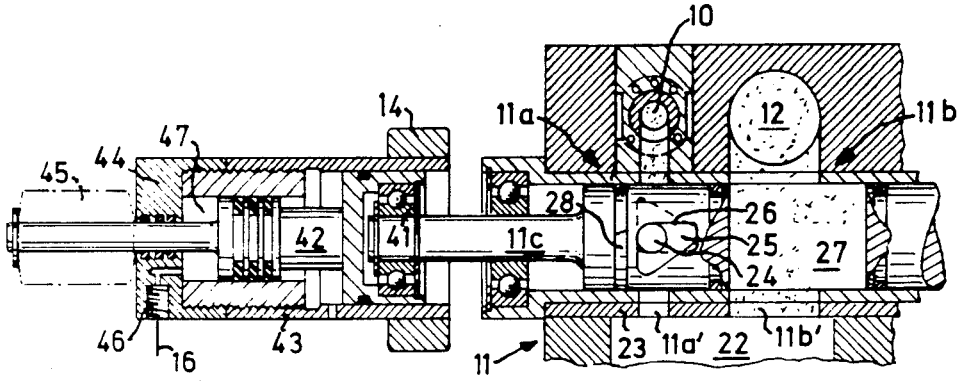
Figure 5:
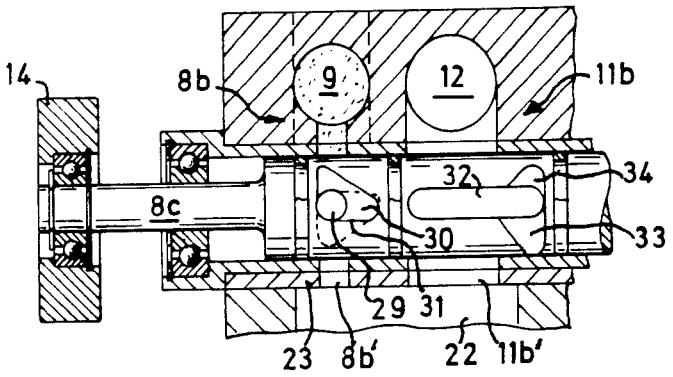
Figure 6:
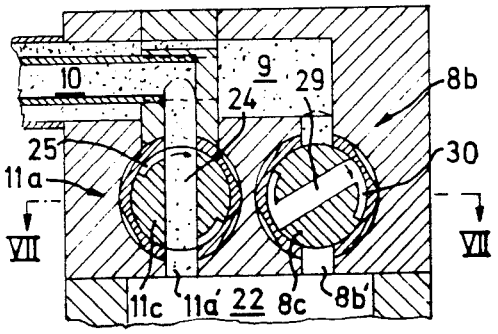
Figure 7:
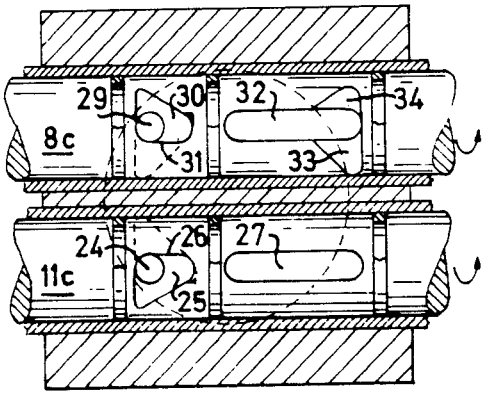
Figure 8:
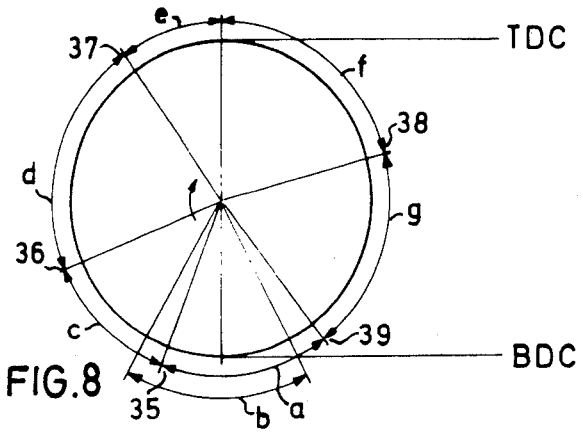
Figure 9:
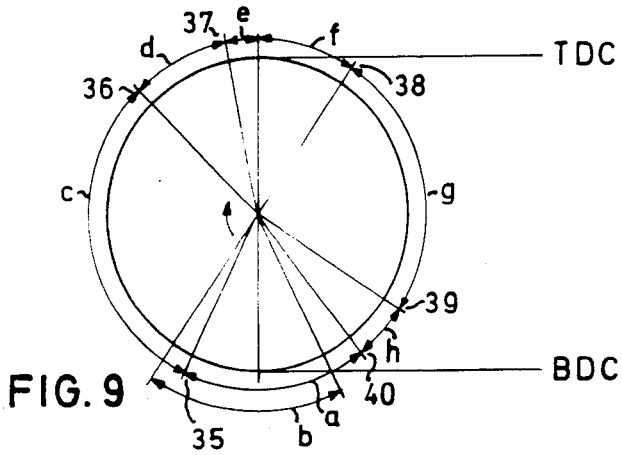
Figure 10:
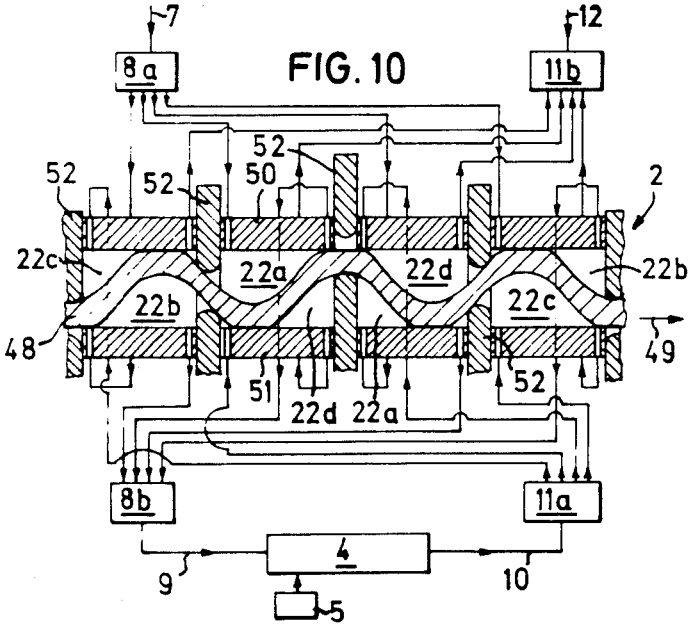

The invention will now be described with reference to embodiments illustrated in the appended drawing, in which FIG. 1 schematically illustrates an engine in accordance with the invention, FIG. 2 is a simplified illustration of an embodiment of the engine in FIG. 1, FIG. 3 is a portion, seen from above, of a valve unit for the embodiment in FIG. 2, FIG. 4 is a longitudinal section along the line IV—IV in FIG. 3, FIG. 5 is a longitudinal section along the line V—V in FIG. 3, FIG. 6 is a longitudinal section along the line VI—VI in FIG. 3, FIG. 7 is a longitudinal section along the line VII—VII in FIG. 6, FIGS. 8 and 9 are valve timing diagrams for two different operational conditions of an engine, and FIG. 10 is a schematic illustration of a variation of the work unit in an engine in accordance with the invention.

An engine 1, illustrated in FIG. 1, for internal combustion of a fuel with the aid of air, is provided with a work unit 2 which, via a valve unit 3, is connected to a combustion unit 4, in turn connected to a fuel supply means 5. The working unit 2 has an output shaft 6 driven with the aid of operating means (not shown) which are movable in work chambers (not shown) in the work unit 2. The operating means have the task of sucking in and compressing air as well as being acted on by combustion gas for driving the working unit.

Air is supplied via an air conduit 7, in which there is an inlet valve **8*a* in a first valve means 8 incorporated in the valve unit 3, the valve 8*a* controlling induction. An arbitrary portion of the inducted air is compressed in the work unit 2 and fed out via a compressed-air conduit 9, connected to the combustion unit 4 via a compressed-air valve 8*b* in the first valve means 8, this valve 8*b* regulating the supply of compressed air. Fuel is supplied to the combustion unit 4 with the aid of the fuel supply means 5, and combustion takes place. The combustion gas obtained is fed, via a combustion gas conduit 10 and a combustion gas valve 11*a* in a second valve means 11, back again to the work unit 2 where it is allowed to expand and perform work on the operating means. The amount of combustion gas to the work unit 2 is regulated with the aid of the combustion gas valve 11***a*. The consumed combustion gas is discharged via an exhaust-gas conduit 12, the discharge being regulated by an exhaust valve 11*b* in the second valve means 11.

The two valve means 8 and 11 in the valve unit 3 each has its respective rotatable slide 8*c* and 11*c*, which are driven synchronously by the shaft 6 via an operating means 13, at a rate which is proportional to the r.p.m. of the shaft 6.

The slides 8*c* and 11*c* are synchronously displaceable axially with the aid of a setting means 14 for varying the times during which the valves incorporated in the valve means 11 and 8 are kept open. The size of the compression and expansion volume in the work unit 2 can thus be regulated by actuation of the setting means 14, which can be regarded as being a "throttle" for the engine. Independent of the particular setting of the setting means 14, the slide 11*c* is furthermore displaceable by means of a pressure regulator 15 which, via a conduit 16, senses the pressure in the combustion unit 4 for finely adjusting the closing point of the combustion gas valve 11*a* in response to said pressure.

A possible embodiment of such an engine 1 is schematically illustrated in FIG. 2, where the work unit 2 has a plurality of operating means in the form of pistons 17 moving reciprocally in their respective cylinder bores 18 and each conventionally connected to the output shaft 6 via a connecting rod 19. All four cylinders have the same execution and, as will be apparent from the cylinder situated farthest to the left, this example shows a modified two-stroke embodiment, where induction to the crank case 20 takes place via an air conduit 7 opening out into the cylinder bore 18. The air inducted into the crank case 20 can then flow into the work chamber 22 situated above the piston 17 via one or more overflow channels 21 opening out in the cylinder bore 18 when the piston 17 is in a suitable position. This practice of the art is well-known for one skilled therein and therefore does not need to be accounted for in detail here.

The work chamber 22 is dimensioned such that its volume is substantially zero when the piston 17 is at its top dead centre (TDC), i.e. the piston 17 reaches substantially up to the cylinder head 23 when it comes to TDC. Each of the work chambers 22 is in communication with the respective valve 11*a*, 11*b* and 8*b*, shown in FIG. 1, via openings 11*a*', 11*b*' and 8*b*' in the cylinder head 23.

As will be seen, the combustion gas conduit 10 is arranged substantially inside the compressed-air conduit 9, whereby the compressed air flowing to the combustion unit 4 is preheated by the combustion gases in a heat exchanger of the counter-flow type.

The combustion unit 4 is formed as a combustion chamber where fuel from the fuel supply means 5 is injected into the incoming compressed air via a nozzle 5*a* in a quantity such that combustion can take place at a substantially constant air-fuel ratio. During combustion, the gas volume increases due to the temperature increase, and volume expansion takes place in the different work chambers 22. During combustion, the pressure is maintained substantially constant via the pressure regulator 15, the function of which will be accounted for later on.

FIG. 3 illustrates in a simple manner a detail of the valve unit 3 and the location in the cylinder head of the openings 8*b*', 11*a*' and 11*b*' with associated conduits 9, 10 and 12, respectively, in an embodiment substantially according to FIG. 2.

At the combustion valve 11*a*, the slide 11*c* is provided with a through-hole 24, both openings of said through-hole being in communication with a substantially triangular depression 25 (see FIGS. 4 and 7) arranged in the cylindrical surface of the slide. Each depression 25 has a forward side 26, seen in the direction of rotation, which is substantially axially directed. Depending on the axial position of the slide 11*c*, combustion gas can thus flow into the work chamber 22 during a short or longer time for half a revolution of the slide 11*c*. As will also be seen from FIGS. 4 and 7, the slide 11*c* is provided with an elongate through-hole 27 at the exhaust valve 11*b*. For sealing purposes the slide 11*c* is provided with a number of annular seals 28. It should be noted that the relative position of the holes 24 and 27 in the rotational direction of the slide are depicted differently in FIGS. 4 and 7, and that the true relative position is another, as will be apparent later on.

It will be seen from FIGS. 5 and 7 that at the compressed-air valve 8*b*, the slide 8*c* is provided with a through-hole 29, each opening of which being in communication with a substantially triangular depression 30 arranged in the cylindrical surface of the slide. Each depression has a rear side 31, seen in the rotational direction, which is substantially axially directed. Depending on the axial position of the slide 8*c*, compressed air can thus flow out from the work chamber 22 during a short or longer time for a half revolution of the slide 8*c*. Similar to the slide 11*c*, the slide 8*c* is provided with annular seals 28.

At the exhaust valve 11*b*, the slide 8*c* has an elongate through-hole 32 with the same position and orientation as the hole 27 in the slide 11*c*. Two depressions 33 and 34 in the cylindrical surface of the slide 8*c* communicate with the respective opening of the hole 32, there being a depression on either side of the hole 32. These depressions 33 and 34 are situated at the short end of the hole 32 which is situated farthest away from the nearest tip of the triangular depression 30. It should be noted that neither does the illustrated relative position of the holes 29 and 32 in the rotational direction of the slide agree with the true position.

The hole 27 in the slide 11*c* fills the same function as the hole 32 in the slide 8*c* and can therefore possibly be dispensed with if the through-flow area of the hole 32 can be made sufficiently large to enable the desired outflow.

It will be seen from FIG. 6 that the compressed-air valve 8*b* and the combustion valve 11*a* are not open simultaneously. The compressed-air valve 8*b* has closed before the combustion valve 11*a* opens.

Valve diagrams for two different working conditions for a piston engine of the type illustrated in FIG. 2 are shown in FIGS. 8 and 9 to elucidate the engine function. When the crankshaft rotates (clockwise according to the arrow), a piston 17 will move reciprocally between an upper top dead centre (TDC) and a bottom dead centre (BDC). In order, the different valves will be open during given sections of a crankshaft revolution.

FIG. 8 represents a case where the load is relatively high and where a relatively large portion, about 70%, of the engine capacity is therefore utilized. Such an operational condition is achieved by displacing the slides 8c and 11c a relatively long way to the right in FIGS. 1, 3, 4, 5 and 7. The openings of the holes 27 and 32 will then at least partially overlap the respective associated openings 11b' in the cylinder head 23 during the portion of the crankshaft revolution denoted by the arc a. This signifies that the arc a represents the time during which the exhaust valve 11b is open. When the piston 17 is at BDC, the exhaust valve 11b is thus open. The overflow channel 21 is simultaneously open during the part of the crankshaft revolution represented by the arc b. The work chamber 22 is now filled with uncombusted air simultaneously as the exhaust port is open. During the piston movement upwards, the overlap between the hole 32 and its associated opening 11b' will cease at 35. However, as a result of the axial position of the slide 8c, the depression 33 will begin to overlap its opening 11b' instead, during the part of the crankshaft revolution represented by the arc c. A certain amount of inducted air will thus once again be discharged via the exhaust valve 11b, without being subjected to compression (cf. the line 12' in FIG. 1). The passage of air enabled by the depression 33 ceases at 36. The piston has now travelled about 30% of its stroke from BDC. Compression then occurs during the part of the crankshaft revolution represented by the arc d. When a compression ratio of about 8:1 has been attained at 37, the piston is at 8.75% of the stroke from TDC. The depression 30 now begins to overlap its opening 8b', the result of which being that the compressed-air valve 8b opens and remains open up to TDC, i.e. during the part of the crankshaft revolution represented by the arc e. When the piston then moves up to TDC, the compressed air will be discharged into the combustion unit 4. When the compressed-air valve 8b has just closed by the side 31 of the depression 30 having passed the opening 8b', the side 26 in the depression 25 comes to its opening 11a' instead, with the result that the combustion gas valve 11a opens at TDC, and remains open during the part of the crankshaft revolution represented by the arc f. The piston is now moving downwards under the action of constant pressure from the combustion gas. The combustion gas valve 11a closes at 38 when the volume of gas above the piston is equal to the volume, transferred by the piston to the combustion unit 4, of compressed air multiplied by the volume increase factor obtained for combustion at constant pressure in the combustion unit.

The combustion gas enclosed in the work chamber 22 is thereafter allowed to move the piston downwards by expansion during the part of the crankshaft revolution represented by the arc g. The exhaust valve 11b opens once again at 39, exhaust then taking place and fresh air being inducted into the work chamber 22. The described cycle is then repeated.

FIG. 9 represents a case where the load is relatively low, and where only a small part, about 15%, of engine capacity is utilized. Such an operating condition is achieved by displacing the slides 8c and 11c a relatively long way to the left in FIGS. 1, 3, 4, 5 and 7. In comparison with FIG. 8, the depression 33 will now overlap its opening 11b' for a longer time, which is represented by the increased length of the arc c. The position 36, where compression begins, will only be about 15% of the stroke from TDC in this example. After this, compression takes place to the same compression ratio as previously, and compressed-air discharge now begins later, closer to TDC, since only a minor portion of the depression 30 will sweep past the opening 8b'. As a result of only a minor portion of the depression 25 sweeping past the opening 11a', combustion gas transfer represented by the arc f will be shorter and will cease closer to TDC than previously. After maximum combustion gas expansion has taken place as represented by the arc g, the depression 34 will begin at 39 to sweep over the associated opening 11b' during the portion of the crankshaft revolution represented by the arc h, up to 40, where the arc a starts. The piston being braked unnecessarily after completed combustion gas expansion is thus avoided by this earlier opening of the exhaust port.

When the engine is working at maximum load, the slides 8c and 11c will be displaced farthest away to the right, as is shown in FIGS. 4, 5 and 7. Neither one of the depressions 33 and 34 will then pass its opening 11b', which signifies that the length of the two arcs c and h is zero. At the same time the arcs d, e and f have maximum length instead. The result of this is that there is no flow-through along the line 12' in FIG. 1, and all inducted air is utilized, i.e. the whole cylinder volume of the engine is utilized. For decreasing load, the slides 8c and 11c can gradually be displaced to the left in FIGS. 4, 5 and 7, so that the flow-through along the line 12' in FIG. 1 is increased and a successively decreasing portion of the engine cylinder volume is utilized.

When the load on the engine is reduced, the temperature ratio between the combustion gas which is supplied to the work chamber and the exhaust gases led out of the work chamber is thus improved. This signifies that the thermal efficiency is improved at loads less than maximum. In comparison with what is the case for conventional engines, there is thus obtained an improved total efficiency during varying engine operating conditions.

The position of the combustion gas valve closing point 38 in FIGS. 8 and 9 is automatically finely regulated with the aid of the pressure regulator 15, the construction of which will be apparent from FIG. 4. The slide 11c is, via a bearing 41, rotatably but axially rigidly connected to a piston 42 running in a cylinder 43 carried by the setting means 14. The piston 42 projects out with one end through the end wall 44 of the cylinder 43 and is loaded there by a spring means 45, e.g. in the form of a number of conical disc springs acting to displace the piston 42 to the left in FIG. 4. The conduit 16 (FIG. 1) connected to the combustion unit 4 is, via an opening 46, in communication with a chamber 47 in the cylinder 43. At a sufficiently high pressure in the chamber 47, the piston 42 will be displaced to the right in FIG. 4, against the bias of the spring means 45. The feed of combustion gas from the combustion unit 4 will hereby increase, whereby the pressure in the combustion unit sinks and balance is achieved between supplied compressed air and removed combustion gas. Pressure decrease in the combustion unit thus results in that the slide 11c is displaced to the left in FIG. 4 as a result of the force from the spring means 45 gaining over the force acting on the piston 42 in the chamber 47. The slide 11c is thus, by means of the pressure regulator 15, axially displaceable in relation to the slide 8c, irrespective of what position the setting means 14 has been set at, e.g. manually by a driver on a motor vehicle in which the engine is fitted.

The work unit 2 as well as the valve unit 3 can naturally be formed in a plurality of other ways than what has been described above without departing from the inventive concept. For example, it is within the scope of the invention also to arrange the inlet valve 8a connected to the cylinder head and to utilize a cylinder embodiment conventional for four-stroke engines. Instead of slide valves, mushroom valves can possibly be used together with a suitable synchronizing means, e.g. one or more cam shafts in the valve unit.

The work unit 2, which has so far been stated to be of an embodiment with reciprocating pistons, can also have other embodiments. In FIG. 10 there is shown, for example, a portion of a work unit 2 where a number of operating means together form a rotor 48 driving the shaft 6 (not shown) in the direction of rotation denoted by the arrow 49. The rotor 48, of which only a peripheral portion has been shown, is surrounded peripherally by a cylindrical wall (not shown) and is situated between two axially spaced end walls 50 and 51 connected to the cylindrical wall. A number of intermediate walls 52, reciprocally movable in the axial direction of the rotor, coact with the rotor and run in radial grooves in the end walls 50 and 51. A number of work chambers 22 on either side of the rotor 48 are defined by said rotor 48, the end walls 50 and 51, the intermediate walls 52 and the cylinder wall (not shown), each work chamber 22 being in communication with one of the valves 8*a*, 8*b*, 11*a* and 11*b*. The work chambers 22*a* are in the position for induction, while the the work chambers 22*b* are in position for discharging inducted air or for compression and discharging compressed air. The work chambers 22*c* in their turn are in position for taking in and expansion of combustion gas, while the work chambers 22*d* are in position for exhaust gas discharge. As will be understood, the openings in each end wall are connected to the different valves in the order, seen in the direction of rotation: 8*a*, 8*b*, 11*a*, 11*b*, 8*a*, 8*b* etc., i.e. in the order the different steps in the working cycle are carried out. The work chambers can be said to be movable in the direction of rotation in this case, and sweep past the connections to the different valves in turn. The different valves can be controlled with guidance from what has been stated hereinbefore, so that the desired working conditions are attained.

An engine in accordance with the invention can be provided with different types of automatic ancillaries, and it is possible, for example, to automatically sense the r.p.m. of the shaft 6 and to control the setting means 14 in response to possible variation in r.p.m. as a result of load variation.

By suitably forming the different valves, it is also possible to compress more air than is required for normal operation of the engine, for example, whereby the engine can be utilized as a combined engine and compressor where excess compressed air can be taken out separately via a compressor outlet.

To obtain good combustion, the work unit should deliver at least four and preferably more compressed-air pulses per crankshaft revolution, and the amount of injected fuel must naturally all the time be adapted to the amount of compressed air introduced into the combustion unit, e.g. in response to the r.p.m. and to the setting of the compressed-air valve 8*b*.

So that the combustion gas valve closing point can be finely regulated even for full throttle, i.e. when the compressed-air valve is completely open, the combustion gas valve must be capable to open somewhat more in this position than what corresponds to full compressed-air supply.

An engine in accordance with the invention can be dimensioned for lower pressure than what is usual in conventional piston engines. The result will therefore be a lighter engine with lighter parts and reduced inertia forces from the movable parts.

I claim:

1. A method for operating a combustion engine comprising the steps of:

inducting into a working chamber an amount of air corresponding to the amount required at full-load operation of the engine;

discharging from the working chamber a first part of the inducted air for retaining a second part of the inducted air in the working chamber, the second part being equal to the amount required for operation at the actual engine load;

compressing the second part of the inducted air until the compression ratio of the second part reaches a predetermined compression ratio that is constant for varying loads;

transferring the compressed air into a combustion chamber, mixing fuel with the compressed air and combusting the mixture of fuel and air in the combustion chamber to produce combustion gas;

transferring the combustion gas into the working chamber and performing work therein with the combustion gas; and discharging the combustion gas from the working chamber.

2. A method as claimed in claim 1, wherein the step of discharging combustion gas begins earlier at low actual engine load than at high actual engine load.

3. A method as claimed in claim 1, wherein the step of transferring compressed air begins earlier at high actual engine load than at low actual engine load.

4. A method as claimed in claim 1, wherein the compressing step comprises opening a conduit to permit the compressed inducted air to flow from the working chamber to the combustion chamber when the predetermined compression ratio is reached.

5. A method as claimed in claim 1, wherein the step of transferring compressed air begins when the predetermined compression ratio is reached in the compressing step.

6. A method as claimed in claim 1, wherein the step of transferring combustion gas further comprises maintaining the pressure in the combustion chamber essentially constant.

7. A method as claimed in claim 6, wherein the substep of maintaining pressure comprises sensing the pressure in the combustion chamber and adjusting the amount of combustion gas transferred to the working chamber according to the sensed pressure.

8. A method of operating a combustion engine, comprising the steps of:

(A) inducting a maximum possible amount of an operating medium into a compression chamber;

(B) discharging the inducted operating medium from the compression chamber until a remaining amount of the inducted operating medium remains in the compression chamber;

(C) compressing the remaining amount of the inducted operating medium until a constant predetermined compression ratio is reached;

(D) transferring at least a part of the compressed operating medium into a combustion chamber;

(E) supplying fuel into the combustion chamber and producing combustion gas therein from the fuel and the transferred operating medium; and (F) transferring at least a part of the combustion gas out of the combustion chamber and performing work using the transferred combustion gas.

9. The method of claim 8 in which the compressing step comprises opening a conduit to permit the compressed operating medium to flow from the compression chamber to the combustion chamber when the predetermined compression ratio is reached.

10. The method of claim 8 in which the step of transferring compressed operating medium begins when the predetermined compression ratio is reached in the compressing step.

11. The method of claim 8 in which the combustion gas transferring step further comprises maintaining a substantially constant pressure in the combustion chamber.

12. The method of claim 11 in which the pressure maintaining substep comprises sensing the pressure in the combustion chamber and adjusting the amount of combustion gas transferred out of the combustion chamber according to the sensed pressure.

13. The method of claim 8, further comprising the step of setting the remaining amount of the inducted operating medium according to the load on the engine.

14. The method of claim 13 in which the setting step comprises setting the amount of the combustion gas to be transferred in the combustion gas transferring step.

15. The method of claim 14, further comprising the step of adjusting the set amount of combustion gas to maintain a substantially constant pressure in the combustion chamber.

16. The method of claim 8, further comprising repeating steps A-F cyclically to operate the engine, the inducting step ending at the same point in each cycle.

17. The method of claim 16, further comprising the steps of setting the remaining amount of the inducted operating medium according to the load on the engine and of cyclically discharging the transferred combustion gas after performing work therewith, the discharging step beginning earlier in relation to the end of the inducting step when the remaining amount of inducted operating medium is set for a light load.

18. The method of claim 16, further comprising the step of setting the remaining amount of the inducted operating medium according to the load on the engine, the step of transferring compressed operating medium begining earlier in relation to the end of the inducting step when the remaining amount of inducted operating medium is set for a heavy load.

19. A method of operating a combustion engine, comprising the steps of:

(A) inducting a maximum possible amount of an operating medium into a compression and expansion chamber;

(B) discharging the inducted operating medium from the compression and expansion chamber until a remaining amount of the inducted operating medium remains in the compression and expansion chamber;

(C) compressing the remaining amount of the inducted operating medium until a constant predetermined compression ratio is reached;

(D) transferring at least a part of the compressed operating medium into a combustion chamber;

(E) supplying fuel into the combustion chamber and producing combustion gas therein from the fuel and the transferred operating medium; and (F) transferring at least a part of the combustion gas into the compression and expansion chamber and performing work therein using the transferred combustion gas.

* * * * *